US008177575B2

(12) United States Patent
Katagiyama et al.

(10) Patent No.: US 8,177,575 B2
(45) Date of Patent: May 15, 2012

(54) CONNECTOR ASSEMBLY

(75) Inventors: Naoki Katagiyama, Tokyo (JP); Hideto Shimazu, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 30 days.

(21) Appl. No.: 12/804,325

(22) Filed: Jul. 20, 2010

(65) Prior Publication Data

US 2011/0021057 A1 Jan. 27, 2011

(30) Foreign Application Priority Data

Jul. 22, 2009 (JP) ..... 2009-171197

(51) Int. Cl.
*H01R 13/62* (2006.01)

(52) U.S. Cl. ..... 439/345

(58) Field of Classification Search ..... 439/345, 439/315, 353, 352, 312, 313
See application file for complete search history.

(56) References Cited

U.S. PATENT DOCUMENTS

| | | | | |
|---|---|---|---|---|
| 4,277,125 | A * | 7/1981 | Ball | 439/311 |
| 4,502,748 | A * | 3/1985 | Brush et al. | 439/313 |
| 5,067,909 | A * | 11/1991 | Behning | 439/315 |
| 6,056,577 | A * | 5/2000 | Blanchet | 439/352 |
| 6,336,822 | B1 | 1/2002 | Luzzoli | |
| 7,236,091 | B2 * | 6/2007 | Kiang et al. | 340/539.1 |

FOREIGN PATENT DOCUMENTS

| | | |
|---|---|---|
| JP | 57-099266 | 1/1984 |
| JP | 63-285884 | 11/1988 |
| JP | 8-220380 | 8/1996 |
| JP | 2000-223209 | 8/2000 |
| JP | 2002-329551 | 11/2002 |

OTHER PUBLICATIONS

Japanese Office Action dated May 9, 2011 along with an English translation of same.

* cited by examiner

*Primary Examiner* — Alexander Gilman
(74) *Attorney, Agent, or Firm* — Collard & Roe, P.C.

(57) ABSTRACT

A connector assembly includes a first connector and a second connector. The second connector has a receptacle portion configured to receive a mating portion of the first connector, a lock key, and a biasing member. The lock key has a pushed portion and is received in the receptacle portion so as to be movable between a locking position and an unlocking position. The biasing member is configured to bias the lock key toward the locking position. The mating portion of the first connector has a positioning key having a pusher and a locking portion. When the first connector is inserted along the insertion direction, the pushed portion is pushed by the pusher, so that the lock key is temporarily moved to the unlocking position and then moved to the locking position. Thus, a mating state of the first connector and the second connector is locked.

16 Claims, 13 Drawing Sheets

CONNECTOR ASSEMBLY

CROSS REFERENCE TO RELATED APPLICATIONS

Applicants claim priority under 35 U.S.C. §119 of Japanese Patent Application No. JP2009-171197 filed Jul. 22, 2009.

BACKGROUND OF THE INVENTION

The present invention relates to a connector assembly including two connectors mated with each other, and more particularly to the connector assembly further having a mechanism for locking a mating state of the connectors.

For example, JP-A 8-220380 discloses a connector assembly including two connectors mated with each other by a ball plunger mechanism. However, the connector assembly of JP-A 8-220380 has no mechanism for locking a mating state of the connectors. Therefore, unintentional force may separate the mated connectors from each other.

In contrast, JP-A 2000-223209 discloses a connector assembly having a mechanism for locking a mating state of two connectors with operation of a lever.

However, the connector assembly of JP-A 2000-223209 requires specific lever operations for locking the mating state. Therefore, there is a need to a connector assembly capable of locking a mating state of connectors with simple operation.

SUMMARY OF THE INVENTION

One aspect of the present invention provides a connector assembly which comprises a first connector and a second connector, wherein the first connector has a mating portion, and the mating portion of the first connector is inserted into the second connector along an insertion direction so that the first connector is mated with the second connector. The second connector comprises a receptacle portion, a lock key, and a biasing member. The receptacle portion is configured to receive the mating portion of the first connector. The receptacle portion includes a positioning key receiver extending along the insertion direction. The lock key is held by the receptacle portion so as to be movable between a locking position and an unlocking position along an entry direction crossing the insertion direction and along a withdrawal direction opposite to the entry direction. The lock key has a pushed portion. The pushed portion is positioned at an end of the lock key in the entry direction. The biasing member is configured to bias the lock key toward the locking position. The mating portion of the first connector has a positioning key extending along the insertion direction. The positioning key is received into the positioning key receiver upon the insertion of the mating portion into the second connector. The positioning key includes a pusher and a locking portion. The pusher is configured to, upon the insertion of the mating portion into the second connector, push the pushed portion of the lock key to temporarily move the lock key along the withdrawal direction to the unlocking position against the biasing member. The locking portion is configured to lock a mating state of the first connector and the second connector in cooperation with the lock key when the lock key is moved back to the locking position by the biasing member after the pusher pushes the pushed portion.

An appreciation of the objectives of the present invention and a more complete understanding of its structure may be had by studying the following description of the preferred embodiment and by referring to the accompanying drawings.

Figure 1:
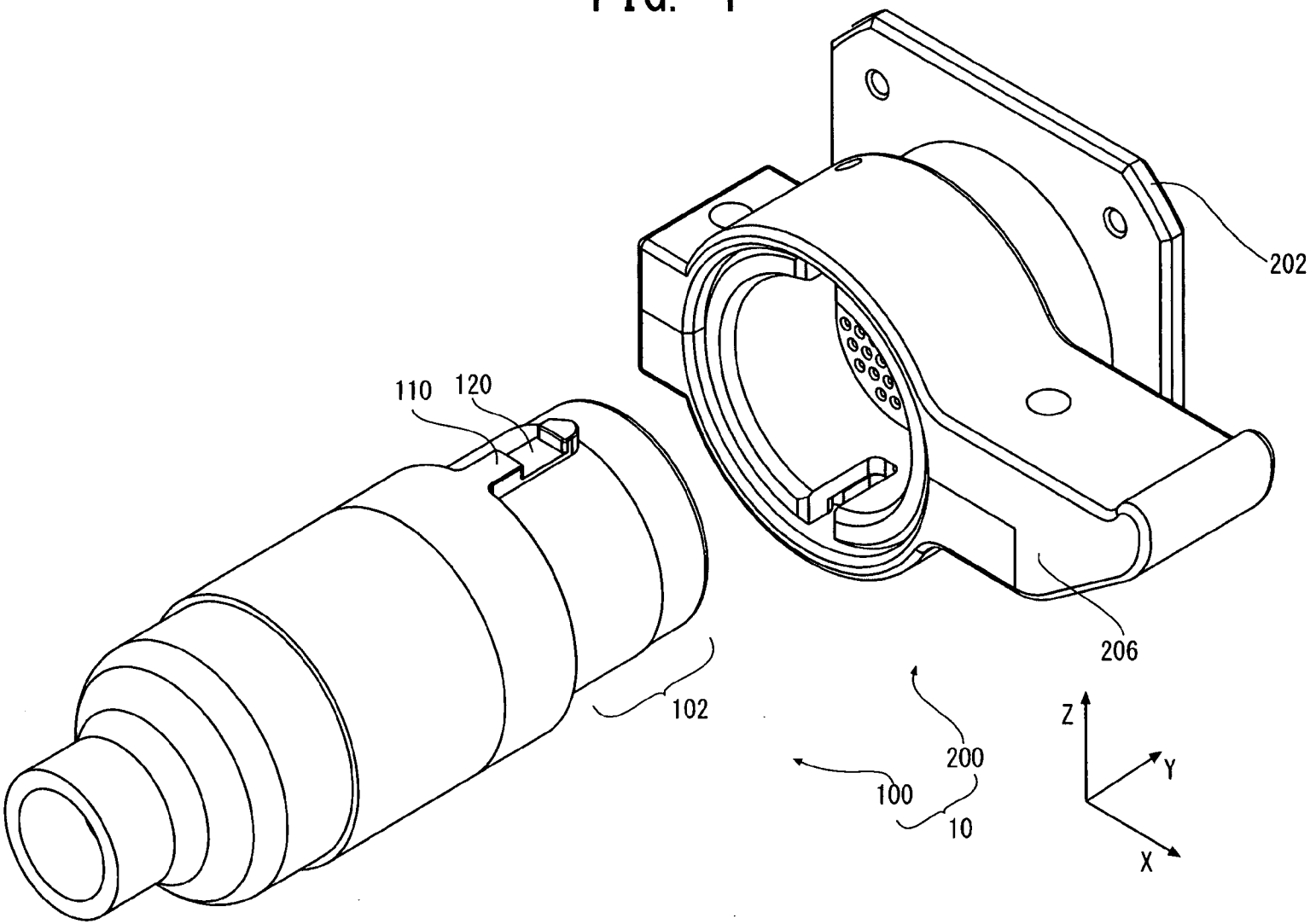
FIG. 1 is a perspective view showing a plug connector and a receptacle connector used in a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

As shown in FIG. 1, a connector assembly 10 according to an embodiment of the present invention includes a plug connector (first connector) 100 and a receptacle connector (second connector) 200. The plug connector 100 is inserted into the receptacle connector 200 along the Y-direction (insertion direction).

Figure 2:
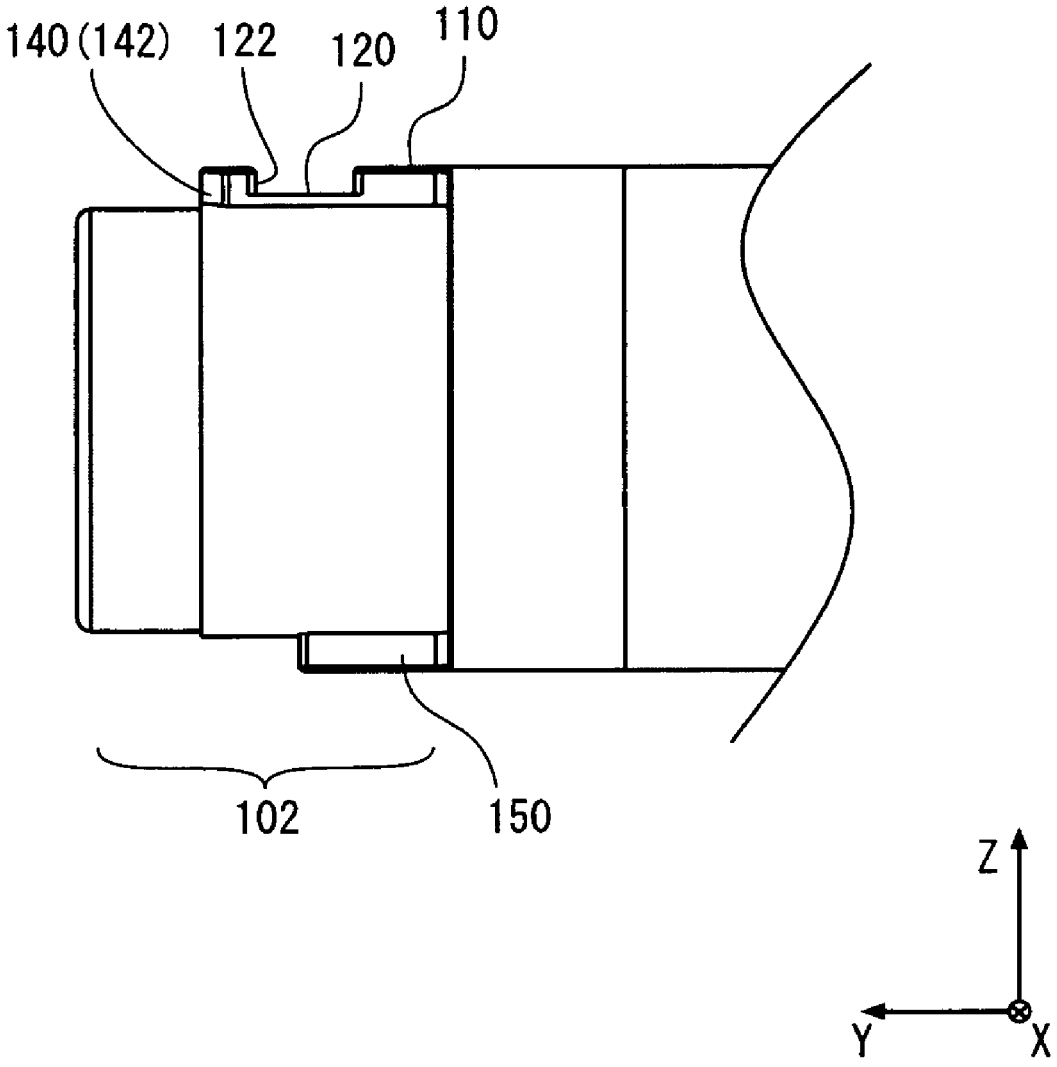
FIG. 2 is a side view partially showing a mating portion of the plug connector of FIG. 1.

As shown in FIGS. 1 and 2, the plug connector 100 has a mating portion 102, which has a circular cross-section on the XZ-plane. The mating portion 102 includes a positioning key 110 and an auxiliary key 150. The positioning key 110 is located at an upper portion of the mating portion 102 in the Z-direction, and the auxiliary key 150 is located at a lower portion of the mating portion 102 in the Z-direction. The positioning key 110 and the auxiliary key 150 extend along the insertion direction.

Figure 3:
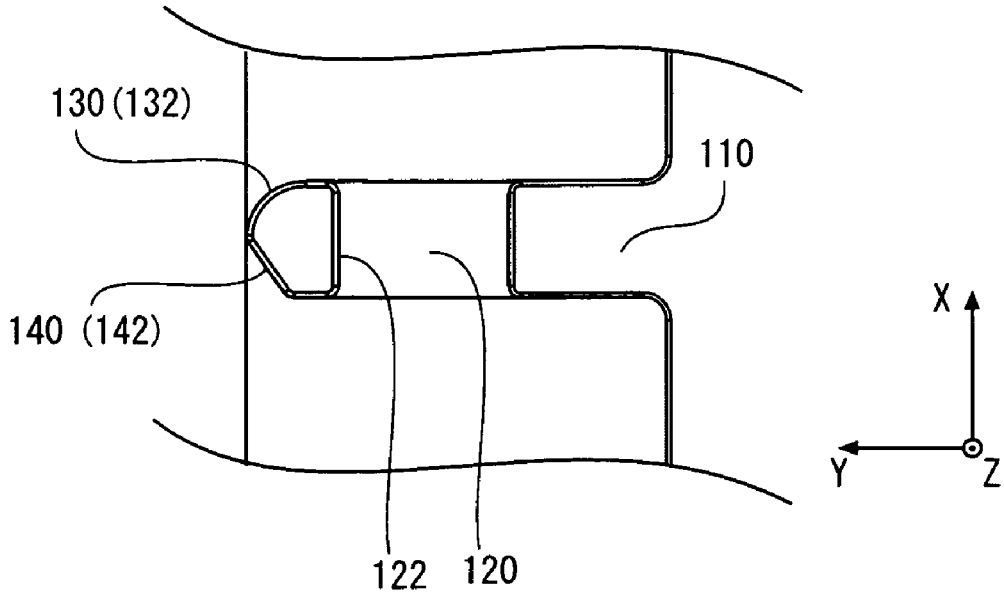
FIG. 3 is a partial enlarged view of a positioning key on the mating portion of FIG. 2 as viewed downward.

As shown in FIGS. 1 to 3, the positioning key 110 includes a locking groove (locking portion) 120, a pusher 130, and a force receiver 140. The locking groove 120 extends along the X-direction. The locking groove 120 has a side surface 122 perpendicular to the insertion direction. The pusher 130 has a contact cam surface 132 having a curved surface crossing both of the insertion direction and a withdrawal direction (the positive X-direction). The force receiver 140 has a force-receiving cam surface 142 crossing both of the withdrawal direction and an ejection direction (the negative Y-direction), wherein the ejection direction is opposite to the insertion direction.

Figure 4:
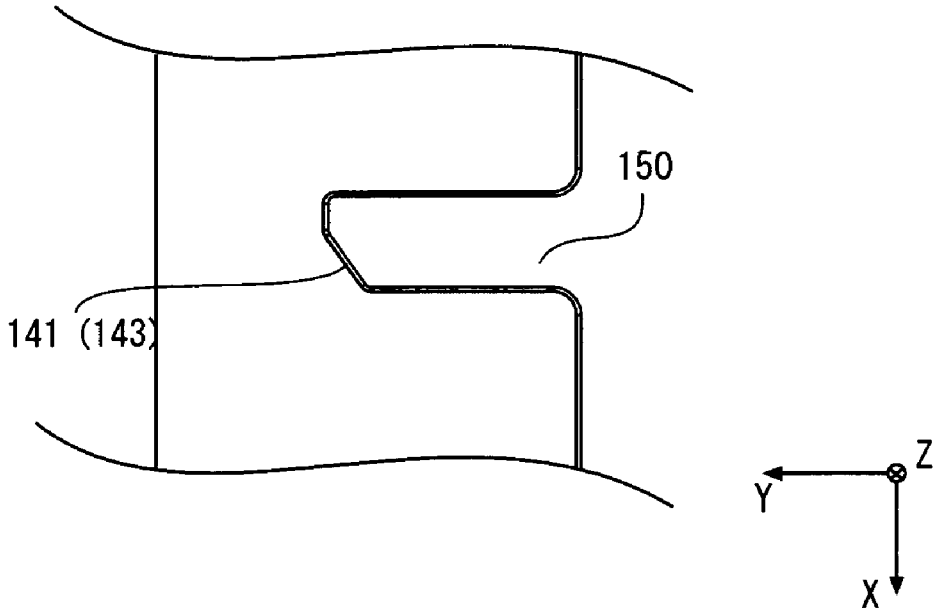
FIG. 4 is a partial enlarged view of an auxiliary key on the mating portion of FIG. 2 as viewed upward.

As shown in FIGS. 1, 2, and 4, the auxiliary key 150 has a force receiver 141. As with the force receiver 140, the force receiver 141 has a force-receiving cam surface 143 crossing both of the ejection direction and an entry direction (the negative X-direction) crossing the Y-direction (insertion direction).

As shown in FIGS. 1 and 5 to 8, the receptacle connector 200 of this embodiment is formed by a combination of two members including a shell member 202 and a locking member 206. The receptacle connector 200 includes a receptacle portion 210, a lock key 220, a spring (biasing member) 230, a ring (ejection member) 240, an auxiliary ring 242, and a lever 250. In this embodiment, the shell member 202 is formed with the receptacle portion 210. The locking member (unlocking member) 206 is formed with the lock key 220 and the lever 250. The spring 230 is held between the shell member 202 and the locking member 206 as described later. The locking member 206 and the shell member 202 are combined with each other by holding the receptacle portion 210 between two members 208*a* and 208*b* of the locking member 206.

Figure 5:
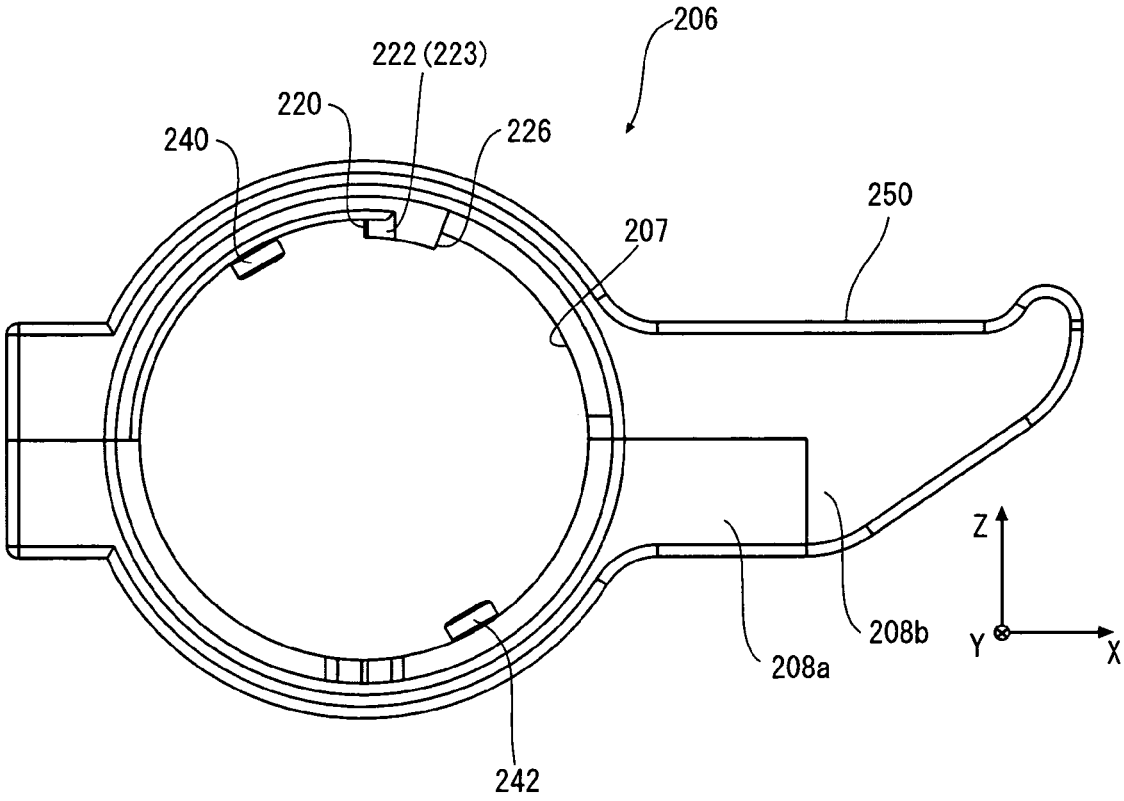
FIG. 5 is a view showing a locking member used in the receptacle connector of FIG. 1.
Figure 7:
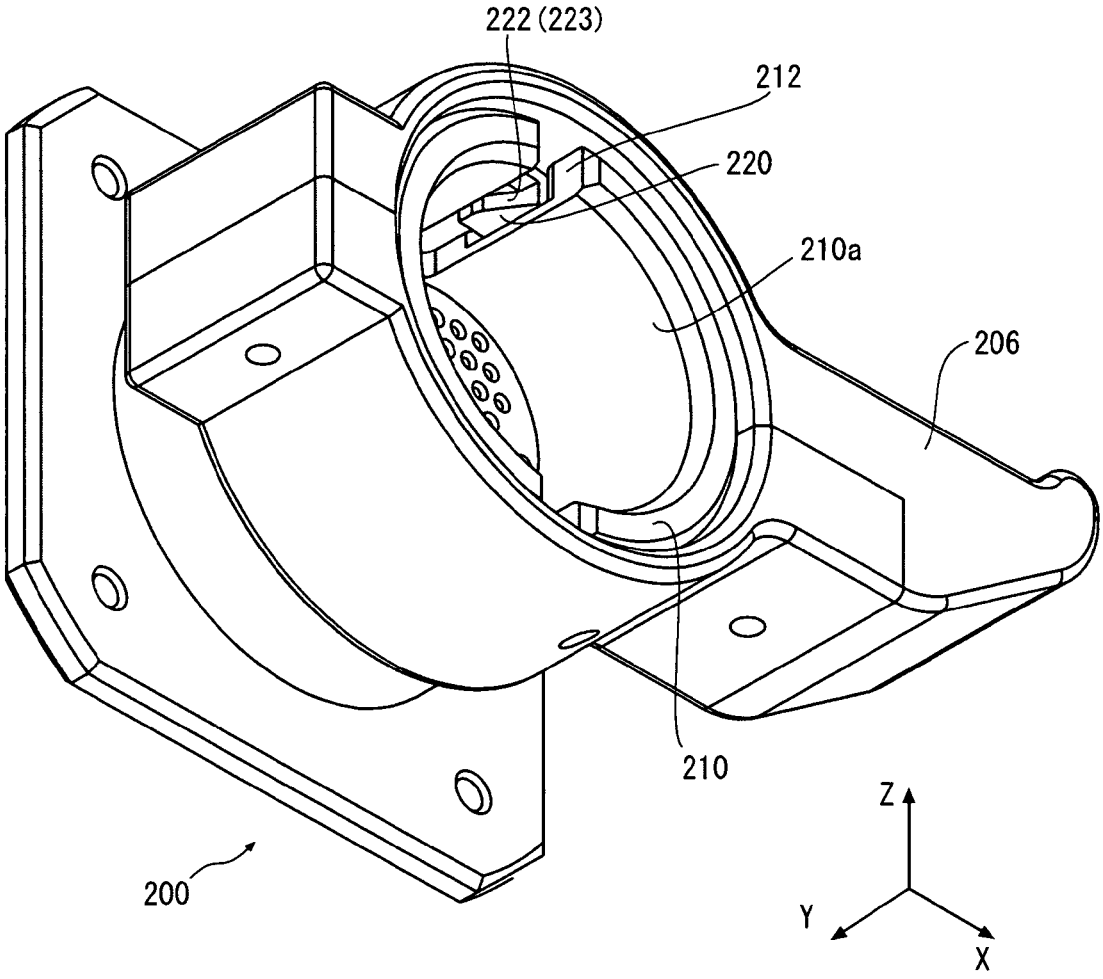
FIG. 7 is a perspective view of the receptacle connector of FIG. 1 as viewed upward.
Figure 8:
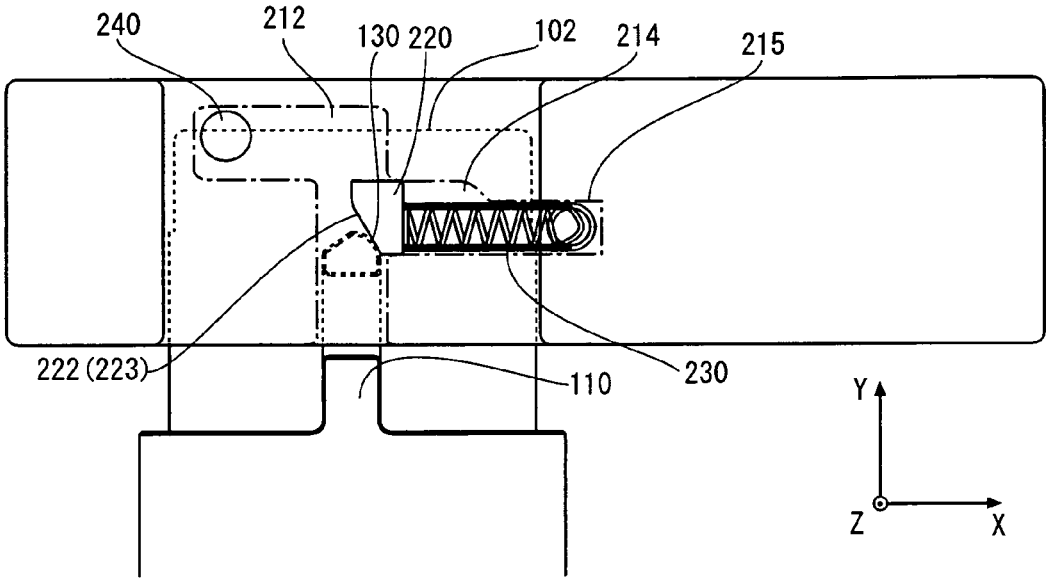
FIG. 8 is a transparent top view showing a positional relationship between the positioning key and a lock key when the plug connector is inserted into the receptacle connector of FIG. 1. Lines of the plug connector, the shell member, and the locking member are partially omitted from the illustration.

As shown in FIGS. 5, 7, and 8, the locking member 206 has a circular inner circumferential surface 207 on the XZ-plane. The locking member 206 includes the lever 250 extending along the X-direction from an outer circumferential surface thereof. The lock key 220 is formed on the inner circumferential surface 207. The lock key 220 projects toward the entry direction. In this embodiment, the insertion direction is perpendicular to the entry direction. As shown in FIGS. 5 and 8, the lock key 220 has a pushed portion 222 on an end thereof. The pushed portion 222 of this embodiment has a contact cam surface 223 crossing both of the withdrawal direction, which is opposite to the entry direction, and the insertion direction. Furthermore, the lock key 220 has a spring abutment surface 226 formed on an opposite side to the pushed portion 222 in the Y-direction. The ring 240 and the auxiliary ring 242 are provided on the inner circumferential surface 207 of the locking member 206. Each of the ring 240 and the auxiliary ring 242 of this embodiment has an outer surface having a circular shape. Each of the ring 240 and the auxiliary ring 242 is supported on the locking member 206 so as to be rotatable about the center of the circular shape.

Figure 6:
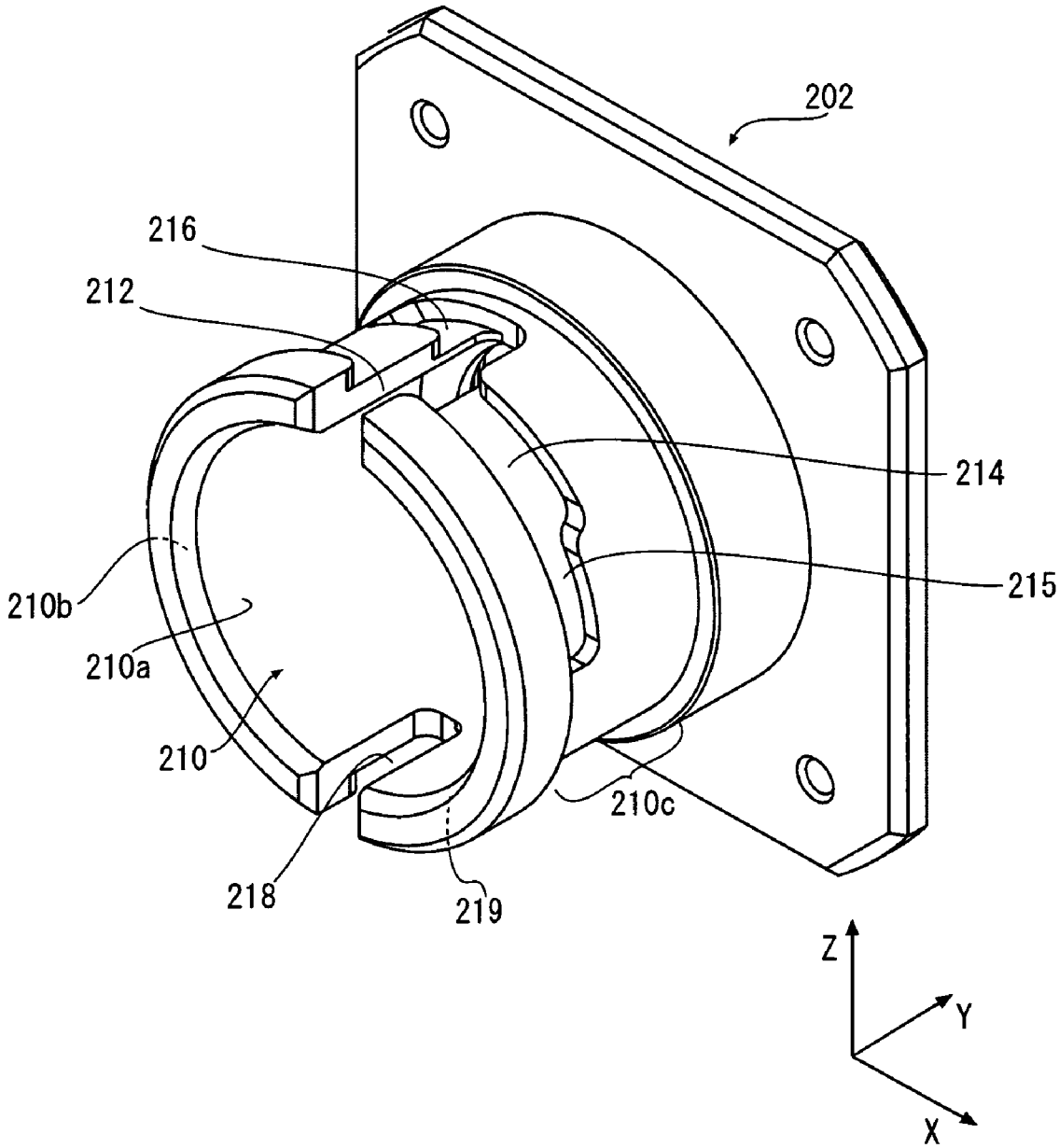
FIG. 6 is a perspective view showing a shell member used in the receptacle connector of FIG. 1.

As shown in FIGS. 1 and 6, the receptacle portion 210 is provided so as to receive the mating portion 102 of the plug connector 100. The receptacle portion 210 has a roughly cylindrical shape having an inner circumferential surface 210*a* and an outer circumferential surface 210*b*. The receptacle portion 210 has a recessed portion 210*c* recessed in the outer circumferential surface 210*b*. The receptacle portion 210 includes a positioning key receiver 212, a lock key receiver 214, a spring receiver 215, a ring receiver (ejection member receiver) 216, an auxiliary key receiver 218, and an auxiliary ring receiver 219. The positioning key receiver 212 extends along the insertion direction. The positioning key receiver 212 is formed by a slit penetrating the receptacle portion 210 between the outer circumferential surface 210*b* and the inner circumferential surface 210*a* of the receptacle portion 210. The lock key receiver 214 is formed by a groove defined in a portion 210*c* of the outer circumferential surface 210*b*. The lock key receiver 214 extends along the withdrawal direction continuously from the positioning key receiver 212. The spring receiver 215 extends along the withdrawal direction continuously from the lock key receiver 214. The ring receiver 216 is formed by a groove defined in the portion 210*c* of the outer circumferential surface 210*b*. The ring receiver 216 extends along the entry direction continuously from an end of the positioning key receiver 212 in the insertion direction. The auxiliary key receiver 218 extends along the insertion direction. The auxiliary key receiver 218 is formed by a slit penetrating the receptacle portion 210 between the outer circumferential surface 210*b* and the inner circumferential surface 210*a* of the receptacle portion 210. As with the ring receiver 216, the auxiliary ring receiver 219 is formed by a groove defined in the portion 210*c* of the outer circumferential surface 210*b*. The auxiliary ring receiver 219 extends along the entry direction continuously from an end of the auxiliary key receiver 218 in the insertion direction. In the present embodiment, each of the lock key receiver 214, the spring receiver 215, the ring receiver 216, and the auxiliary ring receiver 219 is formed by a groove having such a depth that the groove does not reach the inner circumferential surface 210*a*. Thus, abrasion wastes produced by friction between parts during an unlocking operation, which will be described later, is prevented from entering the receptacle portion 210.

The spring 230 is received in the spring receiver 215 and held between the shell member 202 and the locking member 206.

Figure 14:
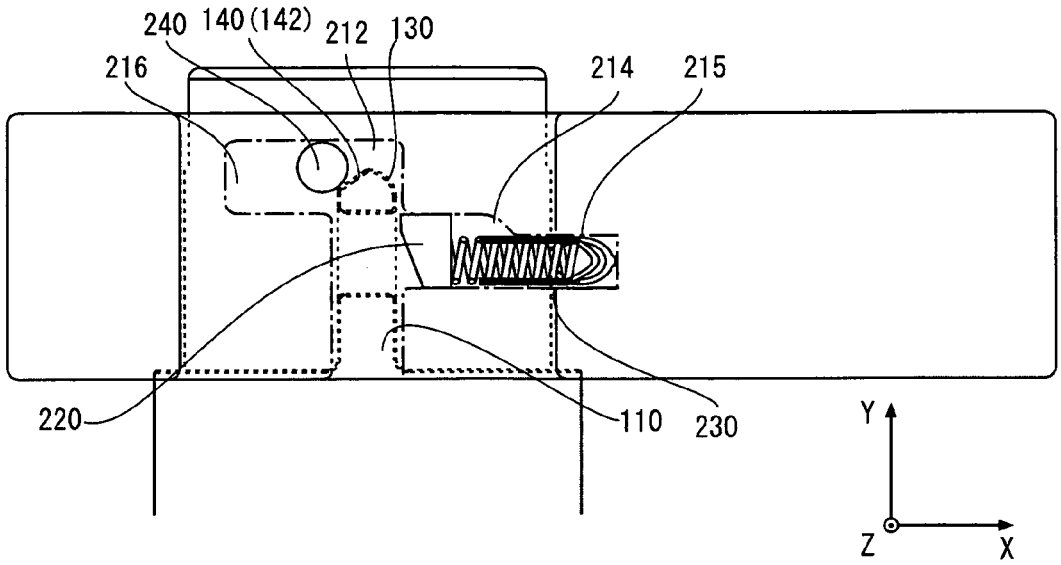
FIG. 14 is a transparent top view showing a positional relationship between the positioning key, the lock key, and a ring when the plug connector and the receptacle connector are being unlocked. Lines of the plug connector, the shell member, and the locking member are partially omitted from the illustration.
Figure 16:
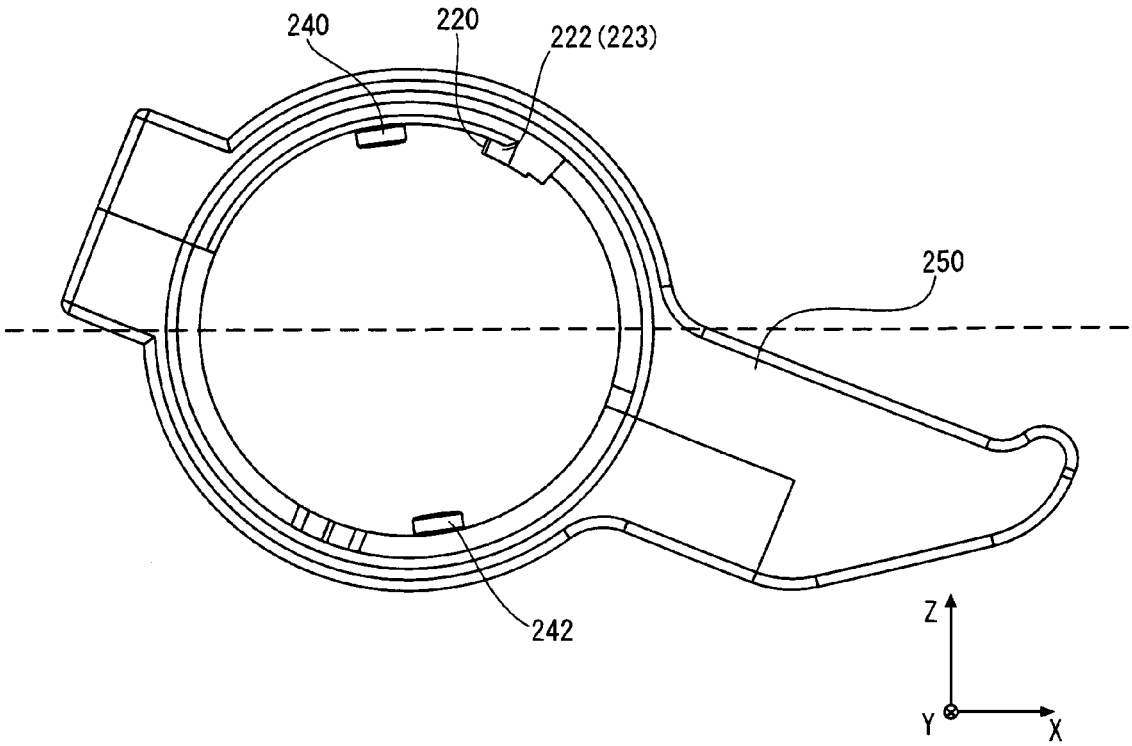
FIG. 16 is a view showing an inclined state of the lever with respect to the X-axis in the state of FIGS. 14 and 15. The illustrated dotted line is in parallel to the X-axis.
Figure 17:
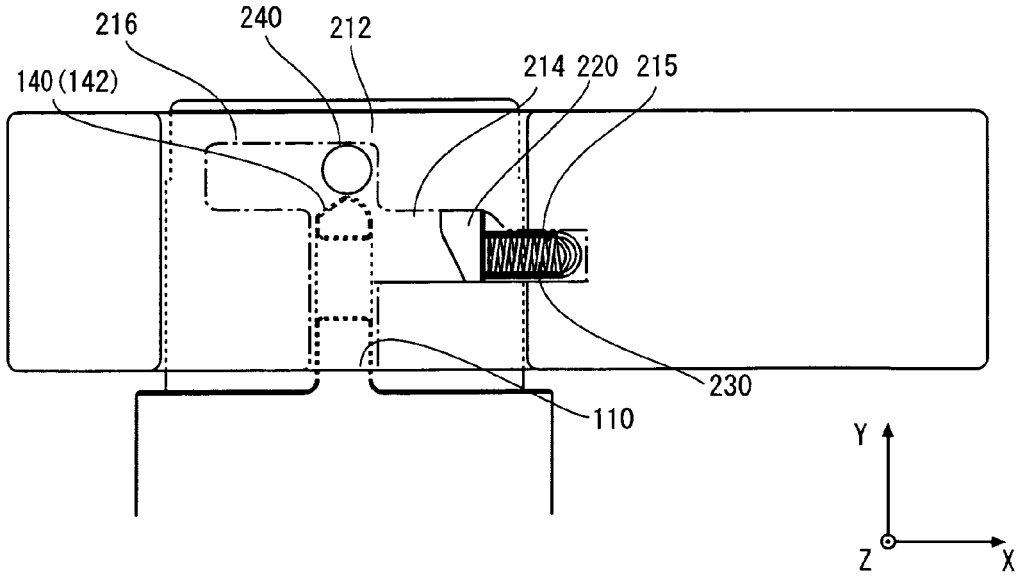
FIG. 17 is a transparent top view showing a positional relationship between the positioning key, the lock key, and the ring when the plug connector is being separated from the receptacle connector. Lines of the plug connector, the shell member, and the locking member are partially omitted from the illustration.
Figure 18:
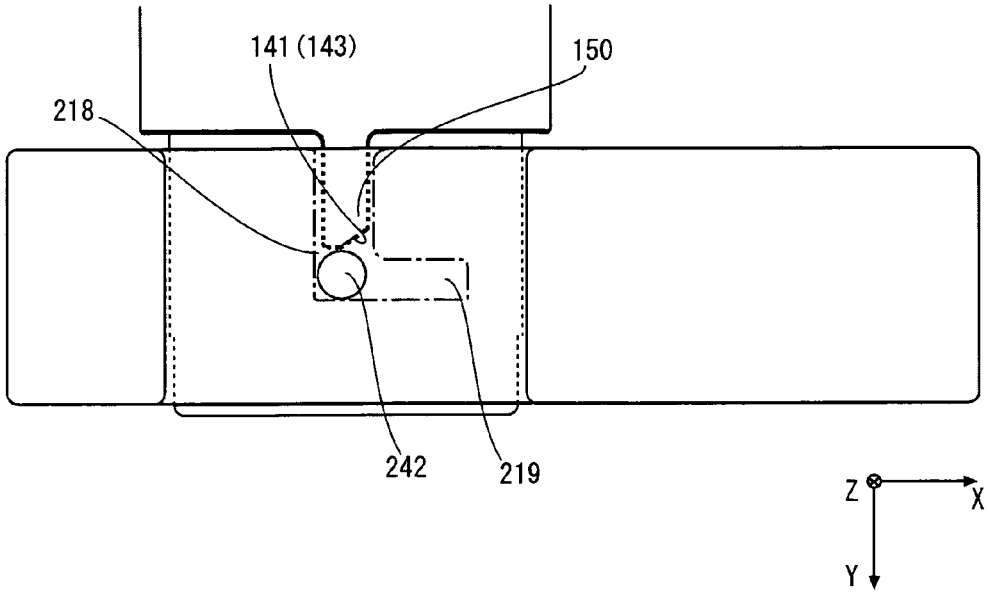
FIG. 18 is a transparent bottom view showing a positional relationship between the auxiliary key and the auxiliary ring in the state of FIG. 17. Lines of the shell member and the locking member are partially omitted from the illustration.
Figure 19:
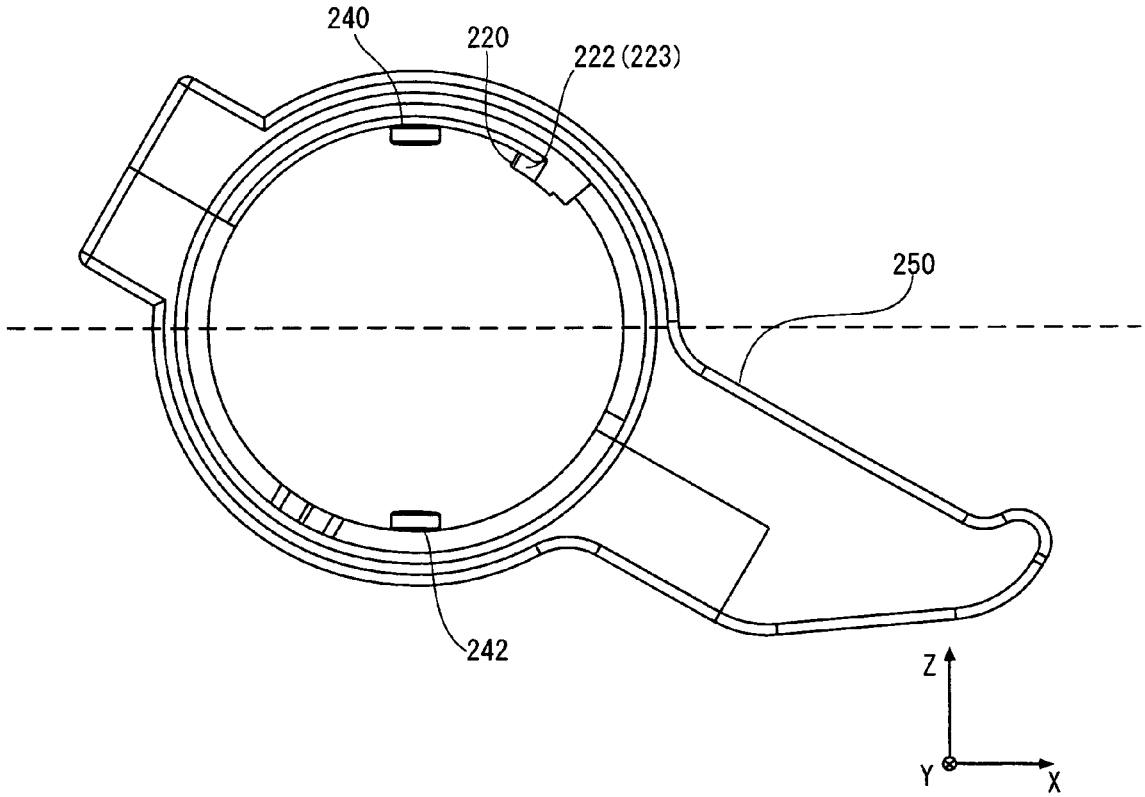
FIG. 19 is a view showing an inclined state of the lever with respect to the X-axis in the state of FIGS. 17 and 18. The illustrated dotted line is in parallel to the X-axis.

As shown in FIGS. 8, 9, 17, and 18, in a state where the shell member 202 and the locking member 206 are combined with each other, the lock key 220 is movable between a locking position and an unlocking position within the lock key receiver 214 along the entry direction and the withdrawal direction. When the lock key 220 is located at the locking position, the pushed portion 222 projects into the positioning key receiver 212. When the lock key 220 is located at the unlocking position, the pushed portion 222 is located within the lock key receiver 214. The ring 240 is movable between an ejection position located within the positioning key receiver 212 and a non-ejection position located within the ring receiver 216 along the entry direction and the withdrawal direction. Similarly, the auxiliary ring 242 is movable between an ejection position located within the auxiliary key receiver 218 and a non-ejection position located within the auxiliary ring receiver 219 along the entry direction and the withdrawal direction. The lever 250 is used to move the lock key 220 from the locking position to the unlocking position along the withdrawal direction. In this embodiment, the lock key 220, the ring 240, and the auxiliary ring 242 are moved in cooperation with the locking member 206. Thus, when the lock key 220 is located at the locking position, the ring 240 and the auxiliary ring 242 are located at the non-ejection positions, respectively (see FIGS. 8 and 9). When the lever 250 is moved downward (rotated clockwise) in the Z-direction as shown in FIG. 16, the lock key 220 is moved to the unlocking position as shown in FIG. 14. When the lever 250 is further moved downward in the Z-direction as shown in FIG. 19, the ring 240 is moved to the ejection position as shown in FIG. 17, and the auxiliary ring 242 is moved to the ejection position as shown in FIG. 18. The spring 230 of this embodiment is located within the spring receiver 215 and is held in contact with the spring abutment surface 226 of the lock key 220 so as to bias the lock key 220 toward the locking position.

Figure 9:
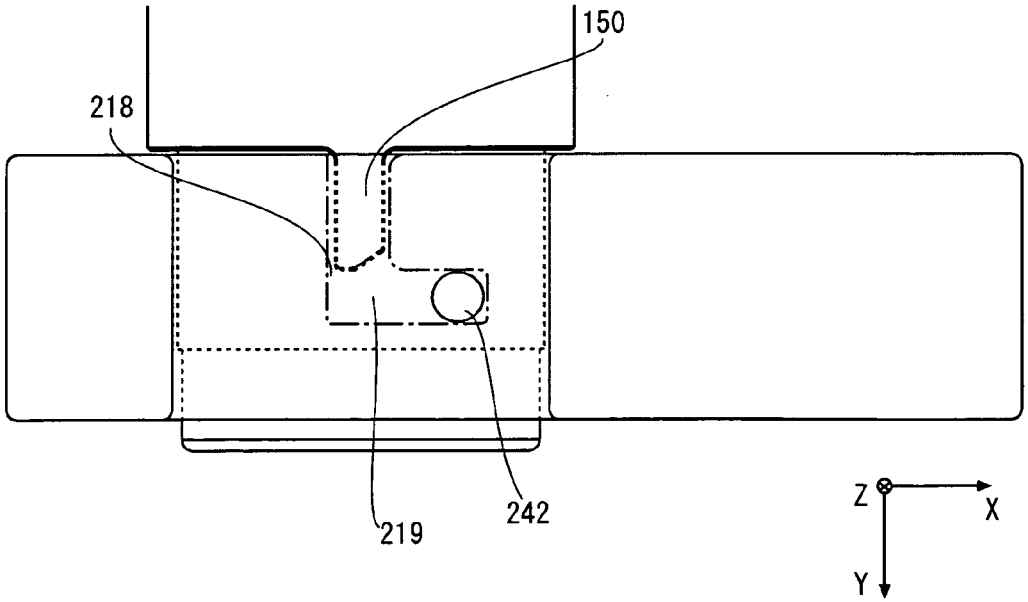
FIG. 9 is a transparent bottom view showing a positional relationship between the auxiliary key and an auxiliary ring in the state of FIG. 8.
Figure 10:
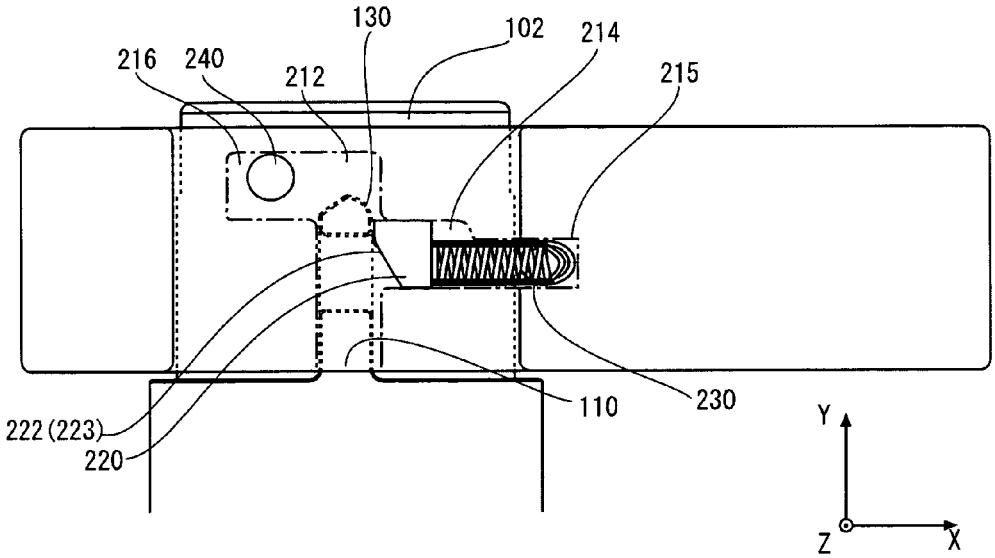
FIG. 10 is a transparent top view showing a positional relationship between the positioning key and the lock key when the plug connector of FIG. 1 is further moved along an insertion direction from the state of FIG. 8. Lines of the plug connector, the shell member, and the locking member are partially omitted from the illustration.
Figure 11:
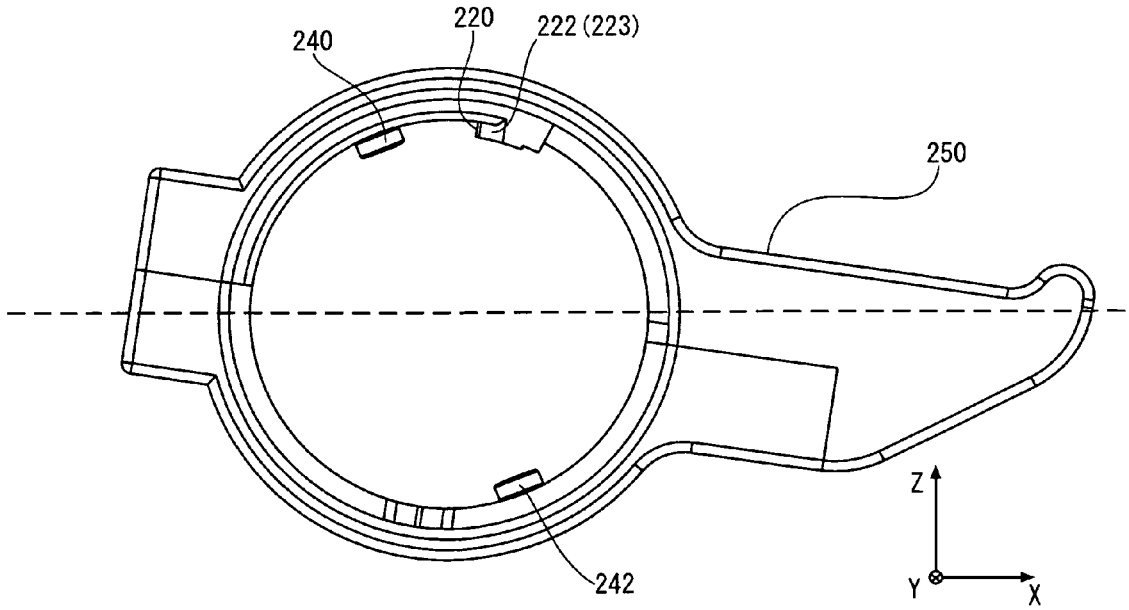
FIG. 11 is a view showing an inclined state of a lever with respect to the X-axis in the state of FIG. 10. The illustrated dotted line is in parallel to the X-axis.
Figure 12:
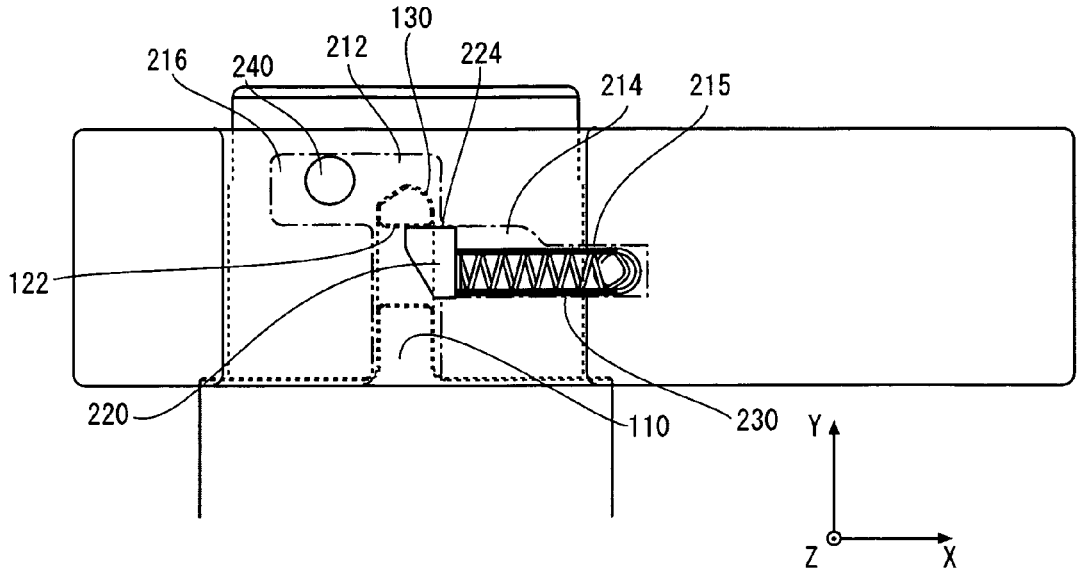
FIG. 12 is a transparent top view showing a positional relationship between the positioning key and the lock key when the plug connector of FIG. 1 is locked. Lines of the plug connector, the shell member, and the locking member are partially omitted from the illustration.
Figure 13:
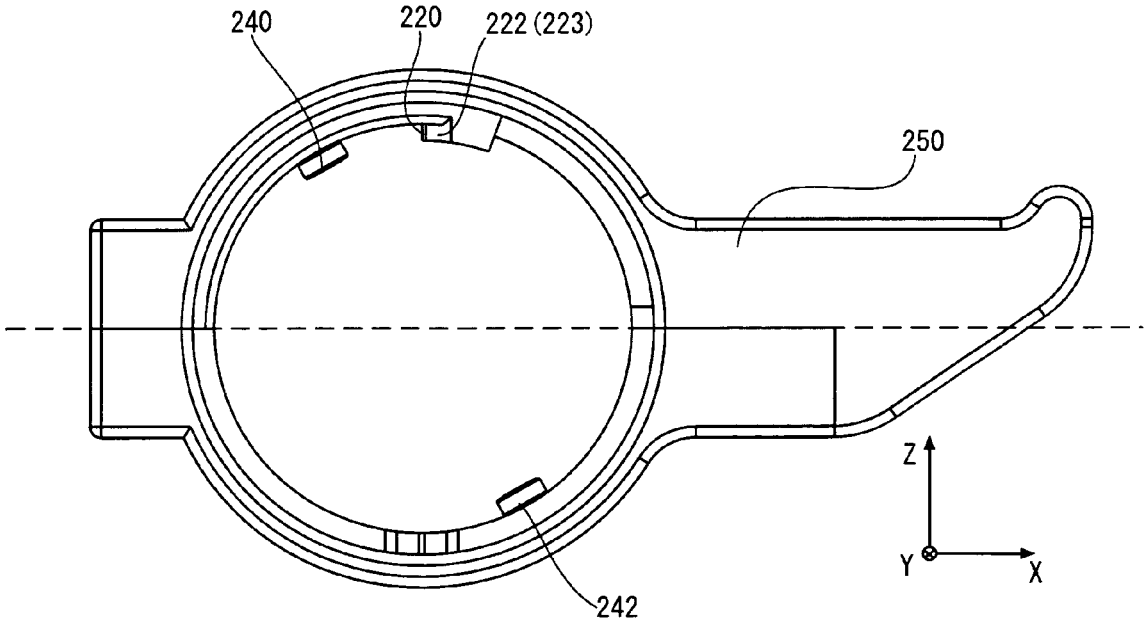
FIG. 13 is a view showing an inclined state of the lever with respect to the X-axis in the locked state. The illustrated dotted line is in parallel to the X-axis.

Next, operation of the plug connector 100 and the receptacle connector 200 according to this embodiment will be described with reference to FIGS. 8 to 19. As shown in FIGS. 8 and 9, when the plug connector 100 is inserted into the receptacle portion 210 so that the positioning key 110 and the auxiliary key 150 are respectively received into the positioning key receiver 212 and the auxiliary key receiver 218, the cam surface of the pusher 130 of the positioning key 110 is brought into contact with the cam surface of the pushed portion 222 of the lock key 220. When the plug connector 100 is further moved along the insertion direction from that state, the pushed portion 222 is pressed by the pusher 130 as shown in FIG. 10. Specifically, the movement of the positioning key 110 along the insertion direction is transmitted as a force directed toward the withdrawal direction to the lock key 220 by the contact cam surface 132 of the pusher 130. Thus, the lock key 220 is temporarily moved to the unlocking position and received in the lock key receiver 214. At that time, as shown in FIG. 11, the locking member 206 is rotated clockwise by the movement of the lock key 220. When the plug connector 100 is further moved along the insertion direction, the pusher 130 is moved to a position beyond the lock key 220 in the insertion direction as shown in FIG. 12. At the same time, the lock key 220 is returned to the locking position by a restoring force of the spring 230 and thus located within the locking groove 120. At that time, as shown in FIG. 13, the lever 250 is returned to the original position. If the plug connector 100 is to be moved along the ejection direction in this state, the locking surface 224 of the lock key 220 is brought into contact with the side surface 122 of the locking groove 120. Therefore, the mating state of the plug connector 100 and the receptacle connector 200 is locked. Thus, the locking groove 120 serves as a locking portion operable to lock a mating state of the plug connector 100 and the receptacle connector 200 in cooperation with the lock key 220.

Figure 15:
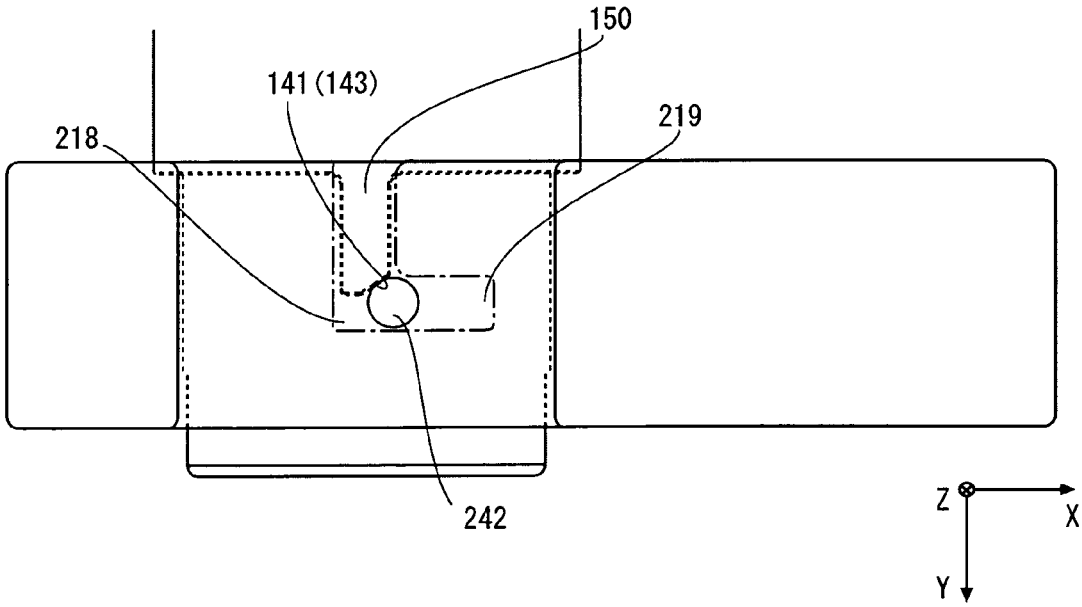
FIG. 15 is a transparent bottom view showing a positional relationship between the auxiliary key and the auxiliary ring in the state of FIG. 14. Lines of the plug connector, the shell member, and the locking member are partially omitted from the illustration.

In the mating state shown in FIG. 12, when the lever 250 is rotated clockwise to the state of FIG. 16, the lock key 220 is moved from the locking position to the unlocking position as shown in FIG. 14. Thus, the locking by the locking groove 120 and the lock key 220 is released (unlocking operation). At the same time, the ring 240 is moved from the non-ejection position toward the ejection position and brought into contact with the force-receiving cam surface 142 of the positioning key 110. Similarly, as shown in FIG. 15, the auxiliary ring 242 is moved from the non-ejection position toward the ejection position and brought into contact with the force-receiving cam surface 143 of the auxiliary key 150. When the lever 250 is further rotated clockwise to the state of FIG. 19, as shown in FIGS. 17 and 18, the lock key 220 is moved beyond the unlocking position while the ring 240 and the auxiliary ring 242 are moved to the ejection positions, respectively. When the ring 240 is moved to the ejection position, the ring 240 applies an ejection force to the force receiver 140 of the positioning key 110, while the rig 240 rotates. When the auxiliary ring 242 is moved to the ejection position, the auxiliary ring 242 applies another ejection force to the force receiver 141 of the auxiliary key 150, while the auxiliary ring 242 rotates. With this operation, the plug connector 100 is moved along the ejection direction. Specifically, the movement of the ring 240 along the withdrawal direction and the movement of the auxiliary ring 242 along the withdrawal direction are transmitted as the ejection forces, which are directed toward the ejection direction, to the force-receiving cam surfaces 142 and 143, respectively. Therefore, the plug connector 100 is moved along the ejection direction. Thus, each of the ring 240 and the auxiliary ring 242 of this embodiment serves as an ejection portion operable to move the plug connector 100 along the ejection direction. In the present embodiment, the ring 240 and the auxiliary ring 242 are configured to move along a direction perpendicular to the insertion direction (i.e., the entry direction and the withdrawal direction). Therefore, no margin is required for movement of the ring 240 and the auxiliary ring 242 in the ejection direction. Accordingly, the size of the receptacle connector can be reduced in a direction of a mating axis (i.e., the insertion direction). Even if the lever 250 is returned to the original position, the plug connector 100 is pushed back in the ejection direction to such a position that the lock key 220 cannot enter the locking groove 120 (auxiliary separation operation). Therefore, it is possible to prevent the plug connector 100 from being re-locked by the lock key 220 after the plug connector 100 is unlocked. Thus, according to the present embodiment, both of the release operation of the mating state and the auxiliary separation operation can be performed by one operation of the lever 250. As described above, the spring 230 of this embodiment biases the lock key 220 toward the locking position. Accordingly, when the lever 250 is released from a user's hand, it is returned to the original position as shown in FIG. 13.

As described above, according to the connector assembly of this embodiment, the mating state of the plug connector 100 and the receptacle connector 200 can be locked merely by inserting the plug connector 100 into the receptacle connector 200. Mere operation of the lever can unlock the mating state and slightly moves the plug connector 100 along the ejection direction. This configuration facilitates the locking process and the unlocking process.

In the present embodiment, the pusher 130 and the pushed portion 222 respectively have the contact cam surfaces 132 and 223, which cross both of the insertion direction and the withdrawal direction. Therefore, as compared to a case where a cam surface is provided only on one of the pusher 130 and the pushed portion 222 (i.e., no curved surface or inclination is provided on the other), it is possible to minimize abrasion wastes produced by friction of the pusher 130 and the pushed portion 222 when the pusher 130 and the pushed portion 222 are brought into sliding contact with each other. Additionally, a force directed toward the insertion direction from the pusher 130 can smoothly transmitted as a force directed toward the withdrawal direction to the lock key 220. If some abrasion wastes do not arise any problem, a contact cam surface may be formed only on one of the pusher 130 and the pushed portion 222. Furthermore, in the present embodiment, the positioning key 110 and the auxiliary key 150 are used to position the plug connector and ensure the separation of the plug connector. However, the auxiliary key 150 may be eliminated if the positioning key 110 has a function of the auxiliary key 150. The positioning key 110 and the auxiliary key 150 of this embodiment are respectively provided on the upper and lower portions of the mating portion 102 of the plug connector 100 in the Z-direction. However, the positioning key 110 and the auxiliary key 150 may be provided at other locations of the mating portion 102.

Figure 20:
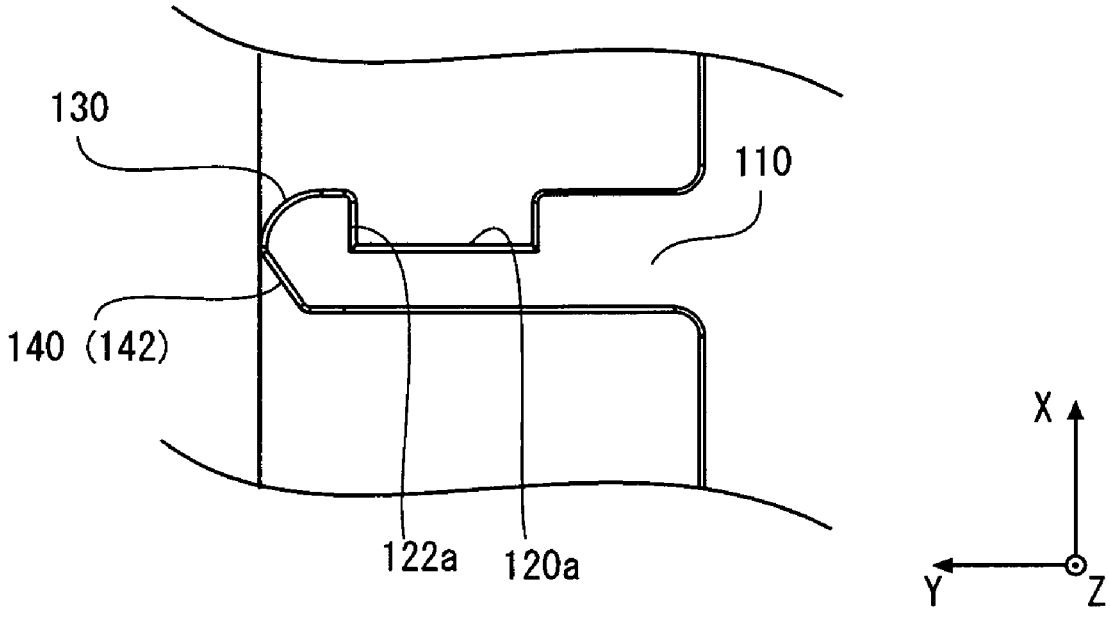
FIG. 20 is a partial enlarged top view showing a variation of the positioning key shown in FIG. 3.

Furthermore, as shown in FIG. 3, the locking groove 120 extends through the positioning key in the X-direction. However, as shown in FIG. 20, a structure that partially receives the lock key 220 may be provided to maintain the locked state. The positioning key 110 shown in FIG. 20 has a recess 120*a* into which the lock key 220 is received. Unlike the locking groove 120 (see FIG. 3), the recess 120*a* does not fully penetrate the positioning key 110 along the X-direction. The recess 120*a* has a side surface 122*a* perpendicular to the insertion direction, and the locking surface of the lock key is brought into contact with the side surface 122*a* of the recess 120*a*.

Furthermore, as shown in FIGS. 8 and 9, the ring 240 and the auxiliary ring 242 of this embodiment has a circular shape. However, the ring 240 and the auxiliary ring 242 may be spherical or cubic. The shapes of the ring 240 and the auxiliary ring 242 are not limited to the above examples as long as the ring 240 and the auxiliary ring 242 are brought into contact with the force receivers 140 and 141 of the positioning key 110 and the auxiliary key 150 so as to separate the plug connector 100 from the receptacle connector 200.

According to the present embodiment, the lever is rotated clockwise to release the locked state and to perform the auxiliary separation operation of the plug connector 100. However, the similar operations may be performed by counterclockwise rotation of the lever. In such a case, the shell member 202 and the locking member 206 are made symmetric with respect to the Z-direction. In order to cope with a plug connector having a roughly rectangular cross-section on the XZ-plane, the receptacle portion 210 and the locking member 206 may be configured to have a roughly rectangular cross-section on the XZ-plane. In this case, for example, a clearance may be formed between the receptacle portion 210 and the locking member 206 in the X-direction or the Z-direction. The locking member 206 may be moved within the clearance to move the lock key 220 from the locking position to the unlocking position.

According to the present invention, when the positioning key is received into the positioning key receiver, the lock key located at the locking position is temporarily moved to the unlocking position. When the pusher is moved beyond the lock key in the insertion direction, the lock key is moved to the locking position. Thus, the mating state of a first connector and a second connector is locked.

According to the present invention, the mating state is locked merely by an operation of inserting the plug connector into the receptacle connector. Furthermore, mere operation of the unlocking member can simultaneously release the locked state and perform the auxiliary separation operation of the plug connector.

A connector assembly according to the present invention is applicable to a connector dedicated to an optical fiber, a photoelectric composite connector having an optical fiber and an electric wire, and an electric connector dedicated to an electric wire.

The present application is based on a Japanese patent application of JP2009-171197 filed before the Japan Patent Office on Jul. 22, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising a first connector having a mating portion and a second connector into which the mating portion of the first connector is inserted along an insertion direction so that the first connector is mated with the second connector, wherein the second connector comprises a receptacle portion, a lock key, and a biasing member, the receptacle portion is configured to receive the mating portion of the first connector, the receptacle portion includes a positioning key receiver extending along the insertion direction, the lock key is held by the receptacle portion so as to be movable between a locking position and an unlocking position along an entry direction crossing the insertion direction and along a withdrawal direction opposite to the entry direction, the lock key has a pushed portion, the pushed portion is positioned at an end of the lock key in the entry direction, the biasing member is configured to bias the lock key toward the locking position, the mating portion of the first connector has a positioning key extending along the insertion direction, the positioning key is received into the positioning key receiver upon the insertion of the mating portion into the second connector, the positioning key includes a pusher and a locking portion, the pusher is configured to, upon the insertion of the mating portion into the second connector, push the pushed portion of the lock key to temporarily move the lock key along the withdrawal direction to the unlocking position against the biasing member, and the locking portion is configured to lock a mating state of the first connector and the second connector in cooperation with the lock key when the lock key is moved back to the locking position by the biasing member after the pusher pushes the pushed portion, wherein each of an outer circumferential surface of the mating portion and an inner circumferential surface of the receptacle portion has a circular shape on a plane perpendicular to the insertion direction, and the entry direction and the withdrawal direction correspond to circumferential directions of the circular shape.

2. The connector assembly according to claim 1, wherein the pushed portion is positioned within the positioning key receiver when the lock key is positioned at the locking position.

3. The connector assembly according to claim 1, wherein at least one of the pusher and the pushed portion has a contact cam surface crossing both of the insertion direction and the withdrawal direction, and the contact cam surface transforms movement of the positioning key along the insertion direction into movement of the lock key along the withdrawal direction so that the lock key is moved from the locking position toward the unlocking position.

4. The connector assembly according to claim 1, wherein the second connector has an ejection member operable to move the mating portion toward an ejection direction opposite to the insertion direction when the lock key is moved from the locking position to the unlocking position or beyond the unlocking position.

5. The connector assembly according to claim 4, wherein the ejection member is moved from a non-ejection position to an ejection position when the lock key is moved beyond the unlocking position along the withdrawal direction, and the positioning key has a force receiver configured to receive an ejection force directed toward the ejection direction from the ejection member when the ejection member is moved from the non-ejection position to the ejection position.

6. The connector assembly according to claim 5, wherein the force receiver has a force-receiving cam surface crossing both of the ejection direction and the withdrawal direction, and the force-receiving cam surface transforms movement of the ejection member along the withdrawal direction into the ejection force.

7. The connector assembly according to claim 5, wherein the second connector has an unlocking member operable to move the lock key from the locking position beyond the unlocking position, and the ejection member is arranged to be moved from the non-ejection position to the ejection position when the unlocking member moves the lock key beyond the unlocking position.

8. The connector assembly according to claim 7, wherein the ejection member has an outer surface of a circular shape and is supported on the unlocking member so as to be rotatable about a center of the circular shape, and when the ejection member is moved along the withdrawal direction, the ejection member applies the ejection force to the force-receiving cam surface with the rotatable outer surface.

9. The connector assembly according to claim 7, wherein the receptacle portion has an outer circumferential surface and an inner circumferential surface, the unlocking member covers the outer circumferential surface of the receptacle portion, the receptacle portion has an ejection member receiver formed in the outer circumferential surface thereof, the ejection member receiver extends along the entry direction from the positioning key receiver, the ejection member receiver does not reach the inner circumferential surface of the receptacle portion, and the ejection member is received in a space defined by the ejection member receiver and the unlocking member unless it is located at the ejection position.

10. The connector assembly according to claim 9, wherein the receptacle portion has a lock key receiver formed in the outer circumferential surface thereof, the lock key receiver extends along the withdrawal direction from the positioning key receiver, the lock key receiver does not reach the inner circumferential surface of the receptacle portion, and the lock key is located within the lock key receiver unless it is located at the locking position.

11. The connector assembly as according to claim 10, wherein the receptacle portion has a spring receiver which is formed to extend continuously from the lock key receiver along the withdrawal direction, and the biasing member comprises a spring member received within the spring receiver.

12. The connector assembly according to claim 1, wherein the receptacle portion has an outer circumferential surface and an inner circumferential surface, the positioning key receiver comprises a slit which penetrates the receptacle portion between the outer circumferential surface and the inner circumferential surface of the receptacle portion, and the positioning key receiver extends along the insertion direction.

13. The connector assembly according to claim 1, wherein the mating portion of the first connector has an auxiliary key extending along the insertion direction, and the second connector has an auxiliary key receiver extending along the insertion direction so as to be receivable the auxiliary key.

14. A connector having a mating portion and being matable with a mating connector, the mating connector comprising a receptacle portion, a lock key, and a biasing member, the receptacle portion being configured to receive the mating portion of the connector along an insertion direction so that the connector is mated with the mating connector, the receptacle portion including a positioning key receiver extending along the insertion direction, the lock key being held by the receptacle portion so as to be movable between a locking position and an unlocking position along an entry direction crossing the insertion direction and along a withdrawal direction opposite to the entry direction, the lock key having a pushed portion, the pushed portion being positioned at an end of the lock key in the entry direction, the biasing member being configured to bias the lock key toward the locking position, wherein the mating portion of the connector has a positioning key extending along the insertion direction, the positioning key is received into the positioning key receiver upon the insertion of the mating portion into the mating connector, the positioning key includes a pusher and a locking portion, the pusher is configured to, upon the insertion of the mating portion into the mating connector, push the pushed portion of the lock key to temporarily move the lock key along the withdrawal direction to the unlocking position against the biasing member, and the locking portion is configured to lock a mating state of the connector and the mating connector in cooperation with the lock key when the lock key is moved back to the locking position by the biasing member after the pusher pushes the pushed portion, wherein an outer circumferential surface of the mating portion has a circular shape on a plane perpendicular to the insertion direction, and the entry direction and the withdrawal direction correspond to circumferential directions of the circular shape.

15. A connector matable with a mating connector when a mating portion of the mating connector is inserted into the connector along an insertion direction, the mating portion of the mating connector having a positioning key extending along the insertion direction, the positioning key including a pusher and a locking portion, wherein the connector comprises a receptacle portion, a lock key, and a biasing member, the receptacle portion is configured to receive the mating portion of the mating connector, the receptacle portion includes a positioning key receiver extending along the insertion direction, the positioning key receiver is configured to receive the positioning key upon the insertion of the mating portion into the connector, the lock key is held by the receptacle portion so as to be movable between a locking position and an unlocking position along an entry direction crossing the insertion direction and along a withdrawal direction opposite to the entry direction, the lock key has a pushed portion, the pushed portion is positioned at an end of the lock key in the entry direction, the biasing member is configured to bias the lock key toward the locking position, upon the insertion of the mating portion into the connector, the pushed portion is pushed by the pusher so that the lock key is temporarily moved along the withdrawal direction to the unlocking position against the biasing member, and the lock key is configured to lock a mating state of the mating connector and the connector in cooperation with the locking portion when the lock key is moved back to the locking position by the biasing member after the pusher pushes the pushed portion, wherein an inner circumferential surface of the receptacle portion has a circular shape on a plane perpendicular to the insertion direction, and the entry direction and the withdrawal direction correspond to circumferential directions of the circular shape.

16. A connector assembly comprising a first connector having a mating portion and a second connector into which the mating portion of the first connector is inserted along an insertion direction so that the first connector is mated with the second connector, wherein the second connector comprises a receptacle portion, a lock key, and a biasing member, the receptacle portion is configured to receive the mating portion of the first connector, the receptacle portion includes a positioning key receiver extending along the insertion direction, the lock key is held by the receptacle portion so as to be movable between a locking position and an unlocking position along an entry direction crossing the insertion direction and along a withdrawal direction opposite to the entry direction, the lock key has a pushed portion, the pushed portion is positioned at an end of the lock key in the entry direction, the biasing member is configured to bias the lock key toward the locking position, the mating portion of the first connector has a positioning key extending along the insertion direction, the positioning key is received into the positioning key receiver upon the insertion of the mating portion into the second connector, the positioning key includes a pusher and a locking portion, the pusher is configured to, upon the insertion of the mating portion into the second connector, push the pushed portion of the lock key to temporarily move the lock key along the withdrawal direction to the unlocking position against the biasing member, and the locking portion is configured to lock a mating state of the first connector and the second connector in cooperation with the lock key when the lock key is moved back to the locking position by the biasing member after the pusher pushes the pushed portion, wherein the mating portion of the first connector has an auxiliary key extending along the insertion direction, and the second connector has an auxiliary key receiver extending along the insertion direction so as to be receivable the auxiliary key.

* * * * *